United States Patent [19]

Huang et al.

[11] Patent Number: 5,052,833

[45] Date of Patent: Oct. 1, 1991

[54] SELF-INKING CONTINUOUS RIBBON CARTRIDGE SYSTEM

[75] Inventors: George C. Huang, Bethany; Peining Yu, New Haven, both of Conn.

[73] Assignee: Jing Tech, Inc., Bethany, Conn.

[21] Appl. No.: 612,013

[22] Filed: Nov. 9, 1990

[51] Int. Cl.[5] ..... B41J 31/16; B41J 35/08

[52] U.S. Cl. ..... 400/197; 400/196.1; 400/202.2; 400/234; 400/200

[58] Field of Search ..... 400/200, 197, 194, 202.2, 400/196.1, 234, 208

[56] References Cited

U.S. PATENT DOCUMENTS

| | | | |
|---|---|---|---|
| 2,770,215 | 11/1956 | Knight | 400/202.2 X |
| 4,364,678 | 12/1982 | Ogan | 400/202.2 |
| 4,741,639 | 5/1988 | Fausto | 400/196.1 |
| 4,747,711 | 5/1988 | Motta et al. | 400/196.1 |
| 4,988,225 | 1/1991 | Huang et al. | 400/196.1 |

FOREIGN PATENT DOCUMENTS

| | | | |
|---|---|---|---|
| 40312 | 11/1981 | European Pat. Off. | 400/196.1 |
| 240112 | 10/1987 | European Pat. Off. | 400/196.1 |
| 3535876 | 4/1987 | Fed. Rep. of Germany | 400/196.1 |
| 2159124 | 11/1985 | United Kingdom | 400/196.1 |

*Primary Examiner*—Edgar S. Burr
*Assistant Examiner*—E. P. Raciti
*Attorney, Agent, or Firm*—McCormick, Paulding & Huber

[57] ABSTRACT

A self-linking continuous ribbon cartridge is provided with an internal self-inking reservoir having a wick positioned in spaced relationship to the ribbon. The ribbon is wrapped around a drum associated with a slip clutch to provide a slight biasing force to a lever so that as the ribbon is moved or driven by the printer mechanism a shoe on the end of the lever moves the ribbon into contact with the wick.

5 Claims, 1 Drawing Sheet

SELF-INKING CONTINUOUS RIBBON CARTRIDGE SYSTEM

BACKGROUND OF THE INVENTION

This application is related to U.S. Pat. No. 4,988,225, issued Jan. 29, 1991. That disclosure is incorporated by reference herein.

The present invention relates to an improvement over the ribbon self-inking feature of the above-identified copending patent application, and deals more specifically with an improved self-inking device for assuring that the ribbon is reinked only when tension is applied to the ribbon by the printer. The cartridge is coupled to a computer by conventional means for movement along a path defined by the cartridge.

The chief object of the present invention is to provide an improved mechanism for holding the ribbon in contact with a wick associated with a self-inking reservoir as the ribbon is moved, and for spacing the ribbon away from the wick when the ribbon stops moving.

SUMMARY OF THE INVENTION

In accordance with the present invention a self-inking continuous ribbon cartridge is provided with a self-inking reservoir and associated wick. The ribbon moves past the wick while the cartridge is provided in and coupled to a computer printer. When the operation of the printer is interrupted for any reason, a ribbon driving spool within the cartridge reduces the tension in the ribbon. Ribbon displacement means is provided for moving the ribbon relative to the wick in the self-inking reservoir. When the ribbon is again tensioned, as when the printer is started up causing the driving spool in the cartridge to apply tension to the ribbon, a portion of the ribbon wrapped around a drum assoicated with the above-identified displacement means causes movement of a shoe in a direction to urge the ribbon against the wick, and in such a direction as to overcome a light biasing spring that urges the shoe toward its inactive position. The advantage of providing a restoring force to the movable shoe, through the medium of the tension in the ribbon itself, represents a substantial improvement over the disclosure in the above-identified copending and commonly assigned patent application.

DETAILED DESCRIPTION

By way of summary, the above-identified application discloses a ribbon cartridge of conventional external configuration that is adapted for use with a variety of computer printers and is therefore interchangeable with a variety of existing ribbon cartridges.

Figure 1:
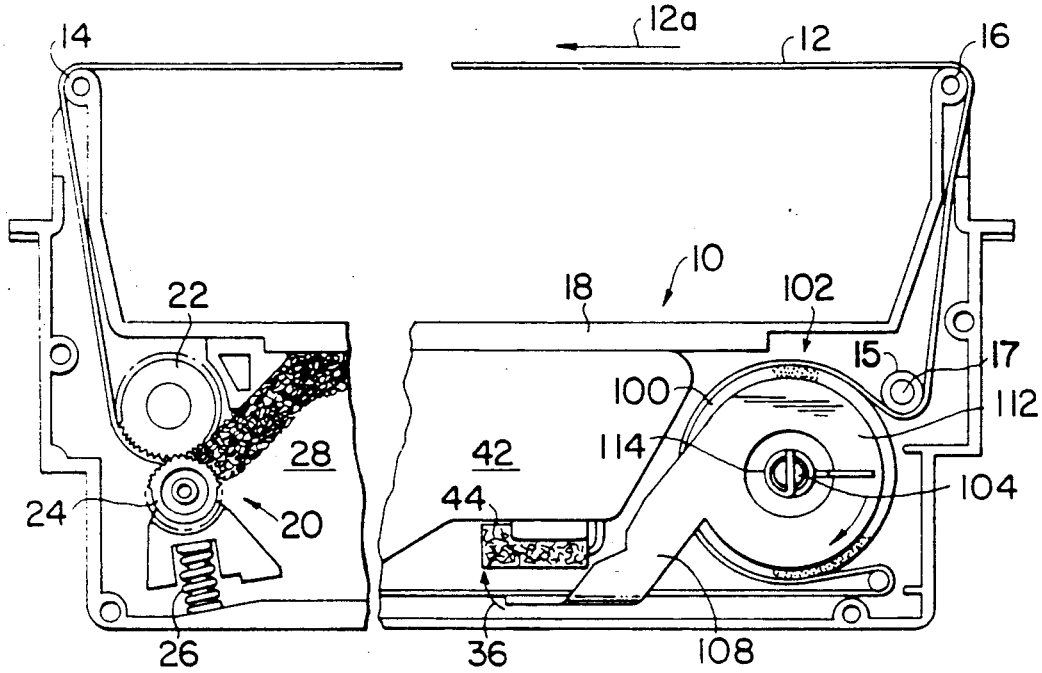
FIG. 1 is a top plan view with portions broken away, of a ribbon cartridge provided with an improved ribbon self-inking mechanism of the present invention.

The ribbon cartridge of FIG. 1 is externally similar to that shown and described in the U.S. Pat. No. 4,988,225 to Huang, et al. and the ribbon cartridge 10 has a ribbon 12 extending between roller assemblies 14' and 16 provided on longitudinally spaced projecting arm portions of the cartridge housing 18.

A driving spool assembly 20 comprises a first or driven roller 22 and a cooperating second roller 24, the latter being biased toward the driven roller 22 by a spring 26. The driven roller 22 is provided on a stub shaft which projects from the housing 18 and is adapted to be received by a suitable advancing mechanism in the printer (not shown). The ribbon 12 is adapted to be moved in the direction indicated generally by the arrow **12*a* by the printer advancing mechanism which rotates the driven roller 22** in a counterclockwise direction in accordance with conventional technology.

The housing 18 defines a cavity 28 which is adapted to receive and to store the ribbon 12 in a nested configuration typical of such ribbon cartridges generally. Means is provided at the end of this cavity 28 opposite the driving spool assembly 20 to define a path or passageway for the ribbon 12 as it exits the cavity 28 and moves from left to right as seen in FIG. 1 past a wick 44 provided in a self-inking reservoir 42 similar to that described with reference to the above-identified patent to Huang.

As described in the patent to Huang, the ink reservoir 42 provides ink in a selectively controlled continuous fashion through the wick 44 only when the printer is in use. A spring is described in that patent having one leg for normally biasing the ribbon away from the wick and an opposite leg acting against the cartridge housing itself. The biasing force of that spring is adapted to be overcome by the tension in the ribbon 12 once the printer has provided the necessary torque through its advancing mechanism to rotate the driven roller 22.

In accordance with the present invention, that spring as disclosed in U.S. Pat. No. 4,988,225, is replaced by a drum 100 that is rotatably received on a slip clutch assembly 102 to be described. The ribbon 12 passes around a relatively significant circumferential extent of the drum 100 so as to provide a clockwise moment or torque on the output or driven end 112 of the clutch assembly 102 whenever the ribbon 12 is advanced by the driven roller 22. In addition to the rollers 14 and 16 a roller 15 and pin 17 are so arranged relative to the ribbons's path that ribbon movement will cause drum 100 to rotate as well.

The clutch assembly 102 is supported on a fixed inner support shaft 104 and the end of the shaft has a slot 105 for receiving one end **114*b* of a coil spring 114. The other end 114*a* of the spring 114 is secured to the driven end of the clutch assembly in the form of end fitting 112*a*. This driven end fitting has a lever arm 108 that is adapted for limited pivotal movement on the axis of fixed shaft 104 to achieve limited movement of the ribbon engageable shoe 110 at the end of arm 108**.

The drum 100 preferably comprises a polymeric material the outer surface of which is adapted to frictionally engage and hence to be driven by the backside of the ribbon 12. The inside diameter of the drum 100 is adapted to engage and to move with the external surface of a drive hub 106.

The spring 114 normally provides biasing movement on the lever arm 108 to urge the lever toward the position shown for it in FIG. 1. The spring 114 also exerts a light axial compressive force between the end fitting 112 and the fixed shaft 104 such that the end face **100*a* of the drum 100 frictionally engages the opposed face of fitting flange 112*a*. This configuration provides a slip clutch feature so designed that the movement of the ribbon, and of the drum will act on the fitting 112 to overcome the biasing moment of spring 114** referred to previously.

Thus, the biasing moment of the spring 106 is chosen to be just large enough to assure that the ribbon 12 is normally out of contact with the wick 44. The tension in the ribbon 12 associated with movement of the ribbon and of the rotating drum 100 assures that a predetermined movement of the lever arm 108 from the position shown in FIG. 1 to a position where the shoe 110 holds ribbon 12 in contact with the wick 44 will be achieved. The concept of utilizing the tension force in the ribbon 12, as achieved by the drum 100 and slip clutch mechanism associated with the lever arm 108, to move the ribbon into contact with the wick provides improved results in cartridge life and in reliability of performance.

Figure 2:
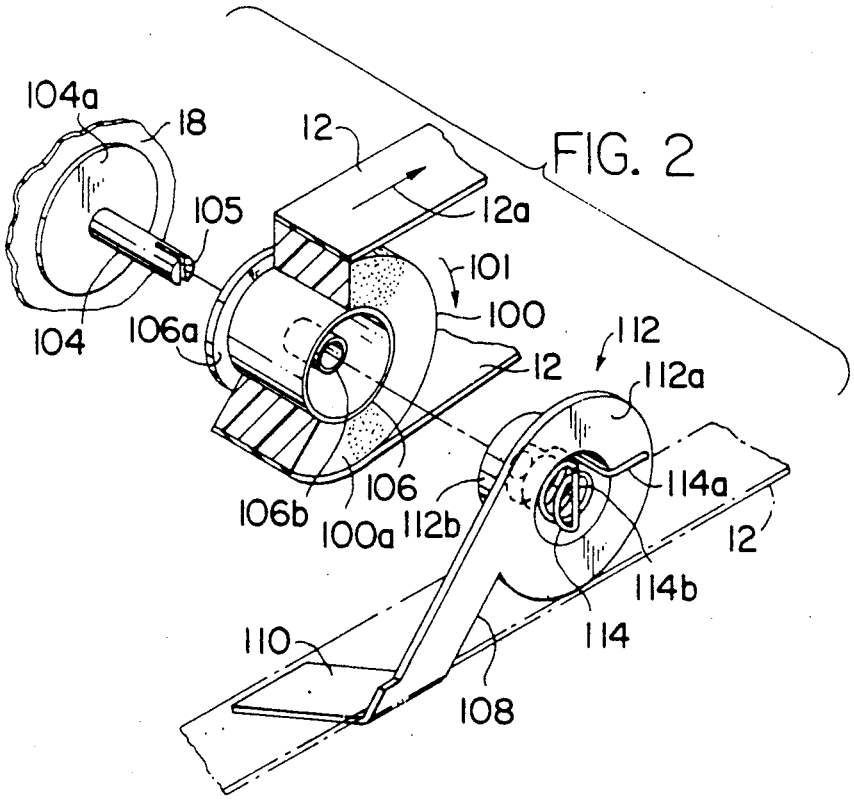
FIG. 2 is an exploded perspective view of the ribbon displacement means, with portions of the drum broken away, and with the ribbon shown in phantom lines.

As shown in FIG. 2 the clutch mechanism comprises the stub shaft 104 projecting from a rear wall of the housing and this shaft 104 has a diametrically slotted outer end as indicated generally at 105. The stub shaft 104 may be integrally molded with the housing 18, which is of thermoplastic material, or in the alternative may be defined by a metal insert having an annular flange portion 104*a* to act as a thrust bearing surface for an annular flange 106*a* on the drive hub 106.

The drive hub 106 is rotatably received on the stub shaft 104 and more particularly the hub 106 has an inner boss 106*b* which is rotatably received on the shaft 104. The drive hub 106 has an outer cylindrical surface snugly received in an opening defined by the drum 100 and rotates with the drum. The drum 100 is fabricated from a wear resistant elastomeric foam material such that the ribbon 12 when wrapped around a substantial portion of the circumference of the drum causes the hub 106 and drum to rotate in the direction of the arrow 101 as the ribbon 12 is moved in the direction of the arrow 12*a* in FIG. 2.

The hub 106 is preferably fabricated from metal as is the shaft 104 so as to provide freedom of rotation for the drum 106 relative to the stub shaft 104.

A hat shaped end portion 112*b* of driven hub or driven end fitting 112 is provided inside the open end of the drive hub 106, and the above described end flange 112*a* cooperates with the flange 106*a* on the drive hub 106 to locate and secure the drum 100 therebetween. The flange 112*a* also defines the arm 108 associated with the shoe 110, and movement of the driven end fitting 112 through a limited angular displacement on the axis of the clutch assembly of FIG. 2 provides the requisite movement of the shoe 110 so that the shoe moves the ribbon 12 from the position shown in FIG. 1 to bring the ribbon into contact with the wick 44 as suggested by the arrow 36.

The generally cylindrical portion 112*b* of fitting 112, rotatably received in the open end of the hub 106, provides a pivotably support for the arm 108. The coil spring 114 is provided inside the end fitting 112, and has end portions 114*a* and 114*b* which allow the spring to be compressed at assembly as described previously. The spring 114 also acts against the end fitting 112 and the arm 108 to urge the arm into the normal position shown in FIG. 1 where the ribbon 12 is not provided in contact with the wick 44. The outer end of the spring 114*a* is secured to the flange 112*a* and the inner end of the spring 114*b* is secured in the slot 105 provided for this purpose in the stub shaft 104. The slotted end of shaft 104 may be peened over at assembly, or the end 114*b* of spring 114 brazed to the slotted end of shaft 104 to provide a predetermined axial compressive force on the drum end face as described above.

In summary, as the ribbon 12 is tensioned and begins to move in the direction of the arrow 12*a*, drum 100 will be rotated in the direction of the arrow 101. The face 100*a* of the drum 100 acts on the inside face of the flange 112*a* of the fitting 112 causing the arm 108 to rotate in the clockwise direction, as viewed in FIGS. 1 and 2, overcoming the biasing moment exerted by the spring 114. This limited movement is followd by a continue torque or movement dictated in part by the rotational speed of the drum 100 and in part by the axial force of spring 114, which torque or moment shifts the ribbon into contact with the wick 44.

Once limited angular motion for the arm 108 occurs, and the ribbon engages the wick 44 the drum 100 and its associated drive hub 106 will continue to be driven on the stub shaft 104 creating a continuing biasing torque or biasing moment on the end fitting 112 and its associated arm 108. When the ribbon's movement stops however, spring 114 will again act to return the arm 108 to its normal position away from wick 44 as illustrated in FIG. 1.

We claim:

1. A ribbon cartridge adapted to being coupled to a computer printing device and comprising; an endless ribbon, a housing having means for guiding the ribbon along a path, and means for driving the ribbon along said path in response to the requirements of a printing device to which the ribbon cartridge is coupled, a self-inking reservoir defining a container for storing liquid ink, a wick provided in said reservoir and having a ribbon engageable portion adjacent to the path of said ribbon but spaced from that path, ribbon displacement means for shifting said ribbon toward said wick portion in response to ribbon movement along said path, said ribbon displacement means including a rotatably supported drum, said ribbon being wrapped at least partially around said drum to rotate said drum when said ribbon is driven, a slip clutch having a drive hub movable with said drum and a driven hub supported for incremental pivotal angular displacement on the axis of the drive hub between first and second positions, and a shoe provided in spaced relation to the pivotal axis of movement of said driven hub to engage said ribbon and shift said ribbon toward said wick portion in the second position of said driven hub.

2. The ribbon cartridge according to claim 1 further characterized by first biasing means to provide a biasing moment urging said shoe away from said wick portion toward said first angular position.

3. The ribbon cartridge according to claim 2 further characterized by second biasing means urging said driven hub axially toward said drive hub, and complementary annular surfaces on said drive and driven hubs whereby said driven hub is rotationally biased away from said first angular position toward said second angular position when said drive hub rotates relative to said driven hub as said ribbon moves along said path.

4. The ribbon cartridge according to claim 3 wherein said first and second biasing means comprise a single coil spring acting in tension to axially urge said drum into engagement with said driven hub, said drum being mounted on said drive hub for rotation therewith.

5. The ribbon cartridge according to claim 4 wherein said coil spring has radially extending end portions, one such end portion fixed relative to said housing and the other end portion secured to said driven hub.

* * * * *